United States Patent [19]

Soles et al.

[11] 4,024,365

[45] May 17, 1977

[54] COMPRESSED-GAS MULTIPHASE CIRCUIT-BREAKER INSTALLATION

[75] Inventors: Otto H. Soles, Irwin, Pa.; Thomas E. Alverson, Brookfield, Ohio

[73] Assignee: Westinghouse Electric Corporation, Pittsburgh, Pa.

[22] Filed: Nov. 27, 1974

[21] Appl. No.: 527,929

[52] U.S. Cl. ..... 200/148 R

[51] Int. Cl.[2] ..... H01H 33/54

[58] Field of Search ..... 200/148 R, 148 A, 148 D, 200/148 E, 148 H, 148; 317/103

[56] References Cited

UNITED STATES PATENTS

| | | | |
|---|---|---|---|
| 3,566,062 | 2/1971 | Meier et al. | 200/148 E |
| 3,603,752 | 9/1971 | Frink | 200/148 H X |
| 3,842,226 | 10/1974 | Yoon | 200/148 R |
| 3,863,041 | 1/1975 | Rostron et al. | 200/148 R X |
| 3,879,591 | 4/1975 | Tschannen et al. | 200/148 E |

*Primary Examiner*—James R. Scott
*Attorney, Agent, or Firm*—W. R. Crout

[57] ABSTRACT

An improved multiphase compressed-gas circuit-interrupter installation is provided having compact, serviceable and inexpensive operating arrangements with an improved gas-leakage detection arrangement and system for detecting a loss of high-pressure gas in each of the multiphase circuit-breaker modules to the exclusion of the other adjacent circuit-breaker phase modules.

An improved operating-linkage rod-assembly is provided extending across the front of the circuit-breaker installation, and readily available for easy servicing and adjustment, so that synchronism of the control valves in the several phase-units, or pole-units may be achieved.

5 Claims, 18 Drawing Figures

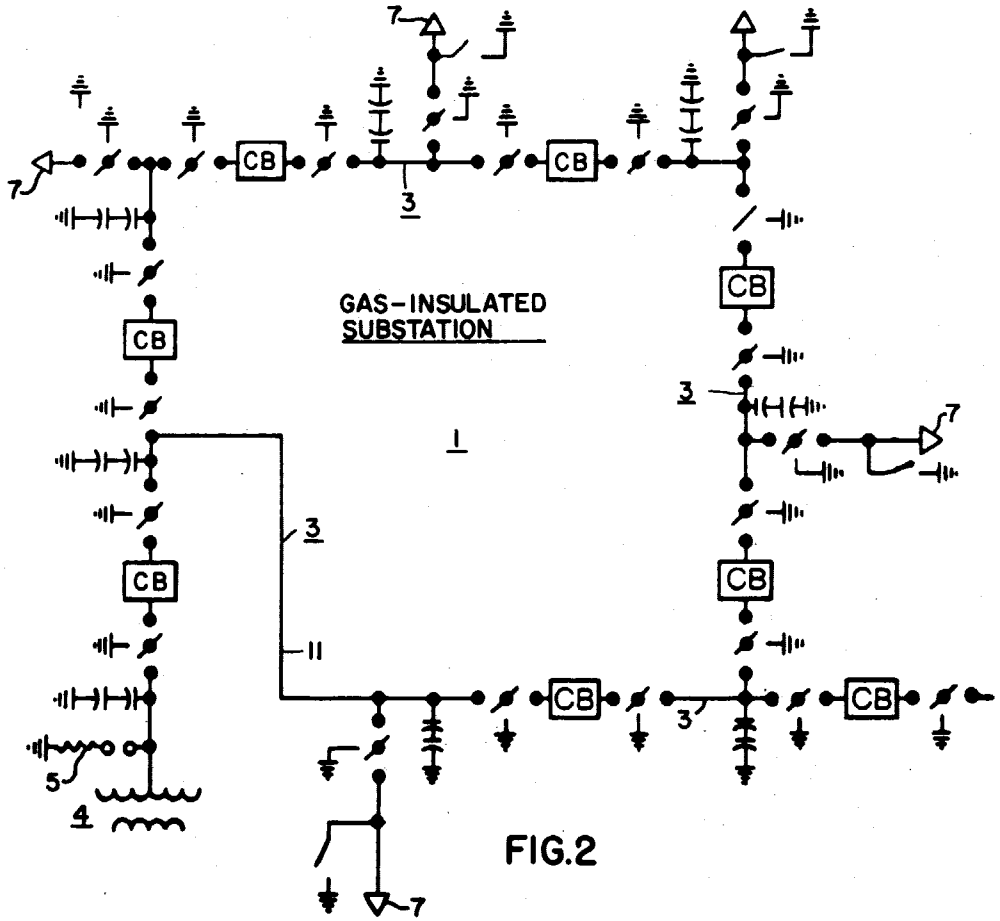
FIG.2
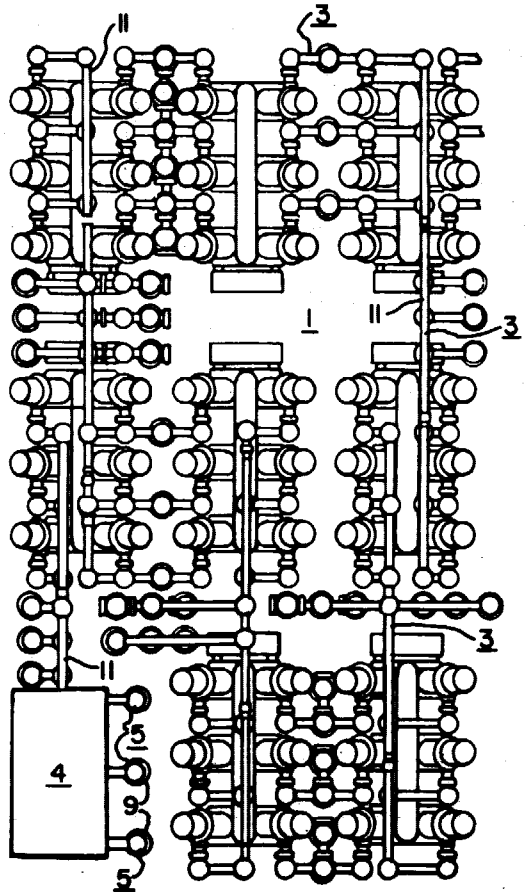
FIG. I

CLOSED POSITION
63
60
57
38
93
55
19
"C"
20
9
13
57

FULLY-OPEN POSITION
63
"C"
57
61
13
19
"B"
20
38
57
"C"
"C" PRESSURE
96

COMPRESSED-GAS MULTIPHASE CIRCUIT-BREAKER INSTALLATION

CROSS-REFERENCES TO RELATED APPLICATIONS

U.S. pat. application filed by Ronald W. Crookston, Thomas E. Alverson and Otto H. Soles, filed Nov. 11, 1974, Ser. No. 522,960, discloses and claims an improved circulating gas-heating construction for supplying heated high-pressure arc-extinguishing gas to the individual upstanding pole-units, or circuit-breaker modules.

U.S. pat. application filed Nov. 27, 1974, Ser. No. 527,930 by Thomas E. Alverson et al. shows a general arrangement and construction for a multiphase compressed-gas type of circuit-interrupter. Also, reference may be had to U.S. pat. application filed Nov. 27, 1974, Ser. No. 527,931, now U.S. Pat. No. 4,005,345, issued Jan. 25, 1977 to Richard E. Kane and Charles LeRow, indicating another general type of operating arrangement. In addition, reference may be had to a position-indicator equipment capable of use in a multiphase circuit-interrupter arrangement, similar to the equipment of the present patent application, as set forth in U.S. pat. application filed Nov. 19, 1974 Ser. No. 525,124, by Ronald Crookston and Charles LeRow, all of the aforesaid patent applications being assigned to the assignee of the instant patent application.

BACKGROUND OF THE INVENTION

As set forth in U.S. Pat. No. 3,694,592, issued Sept. 26, 1972 to Kuhn; U.S. Pat. No. 3,391,243, issued July 2, 1968 to Daniel L. Whitehead; U.S. Pat. No. 3,378,731, issued Apr. 16, 1968 to Daniel L. Whitehead; U.S. Pat. No. 3,361,870, issued Jan. 2, 1968 to Daniel L. Whitehead; and U.S. Pat. No. 3,348,001, issued Oct. 17, 1967 to C. W. Upton, Jr., et al, gas-insulated substation equipment is coming into more extensive use.

Gas-insulated substation equipment, as described in the foregoing patents, and circuit-breaker components have been provided to reduce the necessary ground space required, and also to safely decrease the spacing between elements at widely-different voltage levels. In addition, for supporting the high-voltage power conductors within such gas-insulated piping arrangements, improvements have been made in regard to grounding switches, isolating switches and other component parts of the installation.

Additionally, certain features of the compressed-gas circuit-breaker modules have been set forth and claimed in the following United States patents, which may be referred to for a better understanding of the detailed operating features of the circuit-breaker modules set forth in the instant patent application: U.S. Pat. No. 3,639,713 — Fischer et al; U.S. Pat. No. 3,665,133 — Reese at al.

It is, of course, desirable to provide a compact, serviceable and inexpensive circuit-breaker installation having adjustment of the several parts readily accessible for the maintenance personnel.

SUMMARY OF THE INVENTION

In accordance with the present invention, an improved multiphase gas-insulated circuit-breaker installation of the dual-pressure type is provided having a control-valve rod-linkage assembly in an easily-accessible and readily-available location, and, additionally, providing a unique supporting arrangement by the utilization of a low-pressure gas reservoir tank, the latter, as well known by those skilled in the art, being of rather long length.

Additionally, the present invention is concerned with a novel gas-leakage detection system involving selectively-operated valves, which enables maintenance personnel to quickly readily detect gas leakage from the high-pressure gas system to the low-pressure gas system in a particular circuit-breaker module or pole-unit to the exclusion of the other adjacently disposed pole-units in a minimum of time, and with readily detectable, accurate results, to the exclusion of the influence of said adjacent circuit-breaker modules, or pole-units.

BRIEF DESCRIPTION OF THE DRAWINGS

FIG. 1 is a somewhat diagrammatic view of a gas-insulated substation equipment, showing the general environment and arrangement for one application of the improved multiphase circuit-breaker supporting structure of the present invention;

FIG. 2 is a one-line diagram for the gas-insulated substation power-transmission equipment of FIG. 1;

DESCRIPTION OF THE PREFERRED EMBODIMENT

Figure 4:
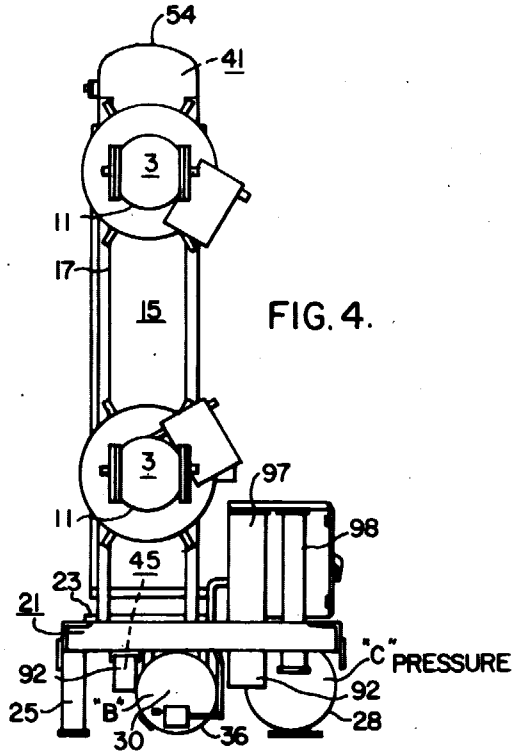
FIG. 4 is an end-elevational view of the three-phase compressed-gas circuit-breaker installation of FIG. 3.

The present invention has particular application to a line of equipment 1 involving gas-insulated substations having gas-insulated components, and somewhat diagrammatically illustrated in FIGS. 1 and 2 of the drawings.

FIG. 2 is a one-line diagram of the equipment 1 illustrated in FIG. 1. It will be noted, from a consideration of FIGS. 1 and 2, that the high-voltage equipment 1 is arranged so that both the space required, and the total length of the gas-insulated bus 3 is minimized. The power transformer 4 is located on an outside corner of the station, preferably, so that it can be easily removed. The gas-insulated bus 3 is attached directly to the transformer-bushing minimizing area and height required. The location of the cable pothead 7 is flexible. In the gas-insulated system 1, as illustrated in FIGS. 1 and 2, it is chosen to minimize the length of the $SF_6$ bus 3. If a lightning arrester 5 is located at each pothead 7, an arrester 5 is not required at the power-transformer 4.

It will be noted that the gas-insulated system 1 of FIG. 1 can be connected to overhead lines. However, the air clearances, required by incoming power lines, will somewhat enlarge the total area required by the system 1, and will require additional $SF_6$ bus 3.

The gas-insulated transmission system 1, illustrated in FIGS. 1 and 2, is a line of equipment, which will significantly reduce the space required by the high-voltage side of substations rated 115 K.V. through 345 K.V. The space reduction is accomplished by replacing the open bus and air terminal-bushings commonly used with gas-insulated bus 3 filled with sulfur-hexafluoride ($SF_6$) gas 9, for example, at 45 p.s.i.g. (at 70° F), and moving the component parts of the electrical equipment as close together as possible.

The use of gas-insulated transmission systems 1 offers many advantages. The use of the system 1 offers several advantages to the utility user, some of these are:

1. Significant reduction in space requirements both in land area and overall height.

2. Added system reliability by eliminating the possibility of phase-to-phase faults, lightning strokes within the system 1, or contamination of the environment.

3. Reduced maintenance because the closed system 1 is isolated from its environment.

4. Added personnel safety because all live parts are covered by grounded shields.

5. The modular approach was chosen because it could provide the utility user with lower installation costs when compared with conventional, or other gas-insulated systems.

6. The system 1 can be overbuilt to permit multiple use of the land.

Generally, the equipment 1 includes a plurality of bus assemblies 3 determined by the length that can generally be shipped. The typical bus length 3 will be, for example, 40 feet, and may consist of two 20-feet lengths, with an epoxy spacer (not shown) in each length. The ends of the bus 3 can be connected to additional lengths of bus 3, if desired, or to any functional member of the system 1. Expansion joints are located in each 20-foot bus-section 3 to absorb the maximum of 0.4 inches of expansion expected. As stated, sulfur-hexafluoride ($SF_6$) gas 9 at 45 p.s.i.g., for example, fills both the sheath 11 and the bus conductor 3, and is free to move throughout the entire bus system 3. The 45 p.s.i.g. $SF_6$ gas pressure provides approximately the highest dielectric strength possible down to −40° C without liquefaction, eliminating the need for auxiliary heat. High-pressure $SF_6$ gas, however, does require a heat input at low ambient temperatures.

Figure 3:
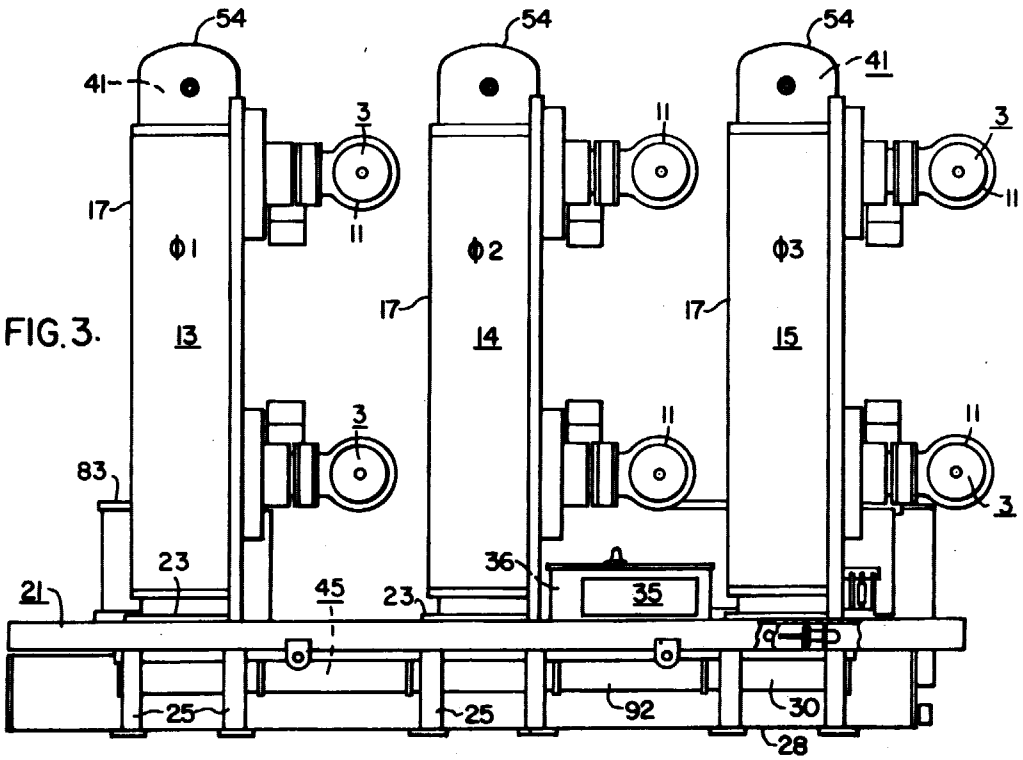
FIG. 3 is a side-elevational structural view of a three-phase compressed-gas circuit-interrupter installation embodying features of the present invention.
Figure 6:
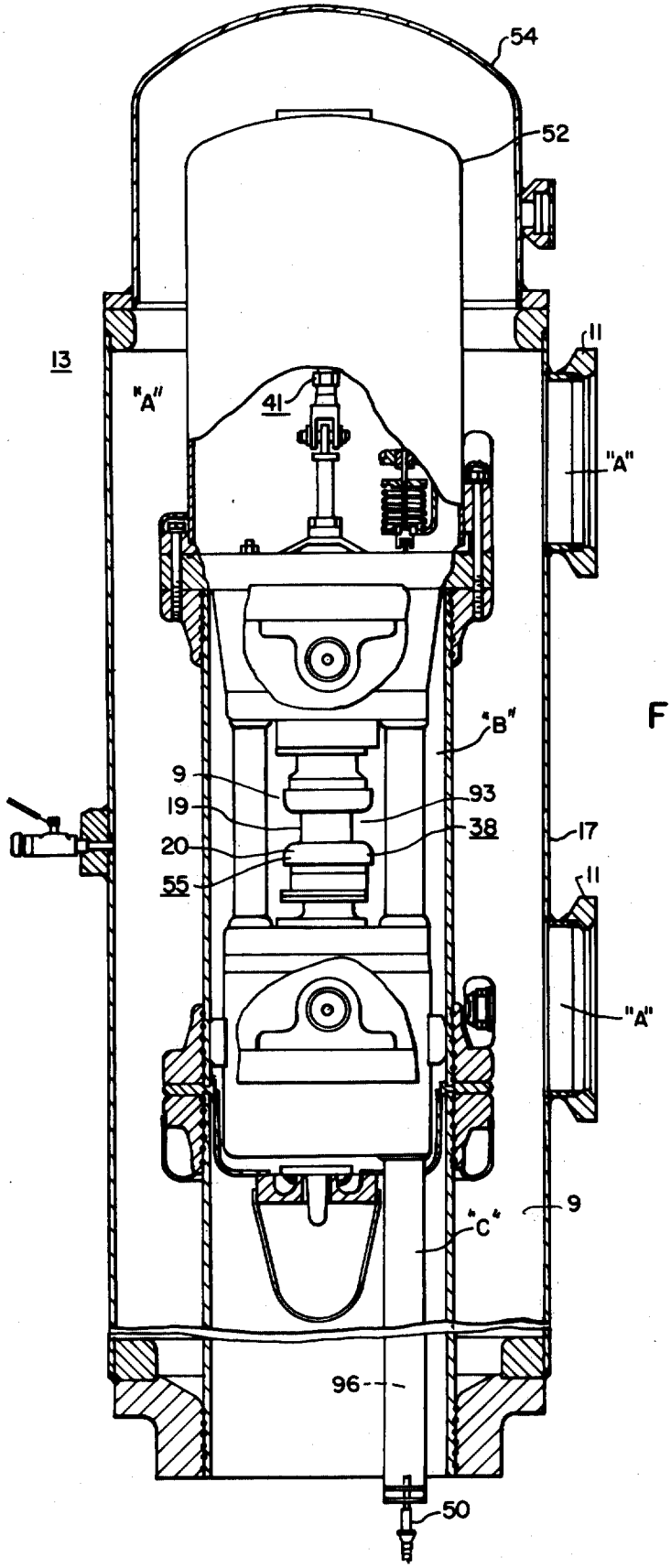
FIG. 6 is a vertical sectional view taken through one of the enclosed circuit-breaker modules illustrating the contact structure in the closed-circuit position, and the valve-control rod extending upwardly through a gas-exhaust guide tube to the upper control-valve disposed in the upper-disposed high-potential operator of the circuit-breaker module controlling the movable contact structure in the module.

With reference to FIG. 3, it will be observed that there are provided three circuit-breaker assemblies, 13, 14 and 15, each including a casing structure 17, as more clearly illustrated in FIG. 6, enclosing separable contacts 19, 20, which are separable to an open-circuit position to establish arcing (FIG. 8) and to effect circuit interruption. Reference may be made to the following United States patents for a detailed description of the individual circuit-interrupter modules 13, 14 and 15; U.S. Pat. No. 3,590,189, issued June 29, 1971; U.S. Pat. No. 3,639,713 — Fischer et al, issued Feb. 1, 1972, U.S. Pat. No. 3,596,028, U.S. Pat. No. 3,624,329 and U.S. Pat. No. 3,665,133.

The circuit-breaker assemblies 13, 14 and 15 are of high capacity and comprise three phase-units, or circuit-breaker modules mounted vertically upon a support frame 21. These breaker-assemblies use sulfur-hexafluoride ($SF_6$) gas 9 for arc-extinction, insulation and operation. The three vertical phase-units, or assemblies 13, 14 and 15, are each mounted upon a base-plate 23. These base-plates 23 are supported by a boxed-in angle-type support frame 21. This frame 21 is supported on one side by rectangular tubing-type legs 25 (FIG. 4). The low-pressure gas reservoir tank 28 serves as a support for the opposite side. Located on one side of the breaker-assemblies 13, 14 and 15 is the low-pressure gas-reservoir tank 28 containing $SF_6$ gas. This reservoir tank 28 has a dual furnction. During normal breaker operation, it contains sulfur-hexafluoride gas 9 at a nominal pressure of 10 p.s.i.g., and also provides a main support for the one side of the breaker 1. This reservoir 28 is an ASME coded vessel. It has a relief valve attached to it and set at 150 p.s.i.g.

The high-pressure gas reservoir tank 30 is located beneath the phase-units, or circuit-breaker assemblies 13, 14 and 15, and provides an adequate high-pressure gas supply. The high-pressure gas reservoir tank 30 contains a heater, and heating of each interrupter assembly 13, 14 or 15 is by gas convection through two-feed-pipes 32, 33 (FIG. 9) from this high-pressure reservoir 30. This reservoir 30 is ASME coded.

A compact weather-proof mechanism housing 35 (FIG. 9) is located between two phase-units 14 and 15. This housing contains the operating mechanism 36 and associated auxiliary switches 37 (FIG. 16) which provide closing and tripping control for the breaker 1. The interrupter columns 13, 14 and 15 consist of the interrupter-module 38 housed within the outer grounded tank 17, and a high-potential operator 41 disposed at the top of each column 13, 14 or 15, as shown in FIG. 6. The interrupter 38 is located in sulfur-hexafluoride gas 9 at a nominal 245 p.s.i.g.

Figures 7, 8:
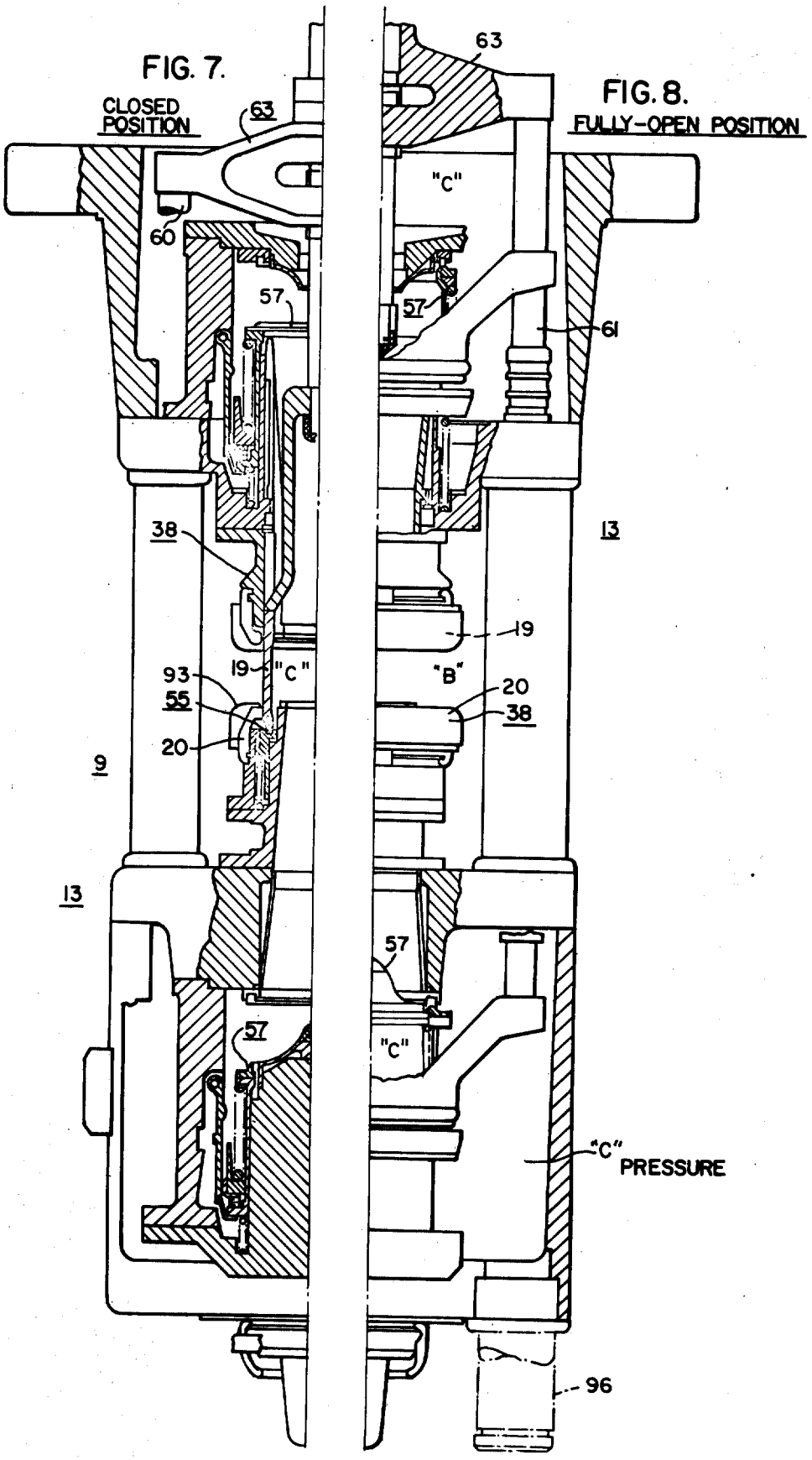
FIGS. 7 and 8 show fragmentary detailed views of the circuit-breaker component parts of FIG. 6, illustrating the circuit-breaker in the open and closed-circuit positions.

The interrupter unit 38 is arranged with the contacts 19, 20 surrounded by high-pressure $SF_6$ gas 9 to give a minimum arcing time. On an opening operation, high-potential operator 41 (FIG. 6) moves the movable interrupter contact 19 upwardly. As contact motion starts, the gas seal is broken between the contacts 19, 20 to permit high-pressure $SF_6$ gas 9, surrounding the contacts 19, 20, to start to flow radially inwardly through the hollow contact assembly. Contact overlap permits the moving contact 19 to attain the desired velocity and gas flow before contact part. Upon contact part, the arc (not shown) is initially drawn between the stationary contact fingers 20 and the moving contact tip 19. Gas flow quickly transfers this arc to the arc tips resulting in a long arc, that is cooled and deionized by the flow of high-pressure $SF_6$ gas 9. Near the end of the moving contact travel, the secondary blast-valves 57 (FIG. 8) are actuated to close and to seal off the gas flow, leaving the opened contacts 19, 20 in an atmosphere of high-pressure $SF_6$ gas as shown in FIG. 8. The total interrupting time from trip-coil energization to arc interruption is two cycles, or less.

The breaker 1 uses high-pressure gas 9 (240 p.s.i.g.) for primary insulation to ground, insulation across the open contacts 19, 20 pressure differential for gas flow to the 10 p.s.i.g. low-pressure gas system during arc interruption, and energy for breaker operation. $SF_6$ gas 9 is used at an intermediate pressure of 45 p.s.i.g. in region A (FIG. 6) for high dielectric strength in the area immediately inside the grounded tank assembly 17. There is no $SF_6$ gas circulation between this insulation system A and the other two pressure systems B and C (FIG. 6).

Sulfur-hexafluoride gas 9 in a pure state is inert and exhibits exceptional thermal stability. It has excellent arc-quenching properties. These characteristics, combined with its exceptionally-good insulating properties, make it an excellent medium for use in circuit-breakers.

Figure 11:
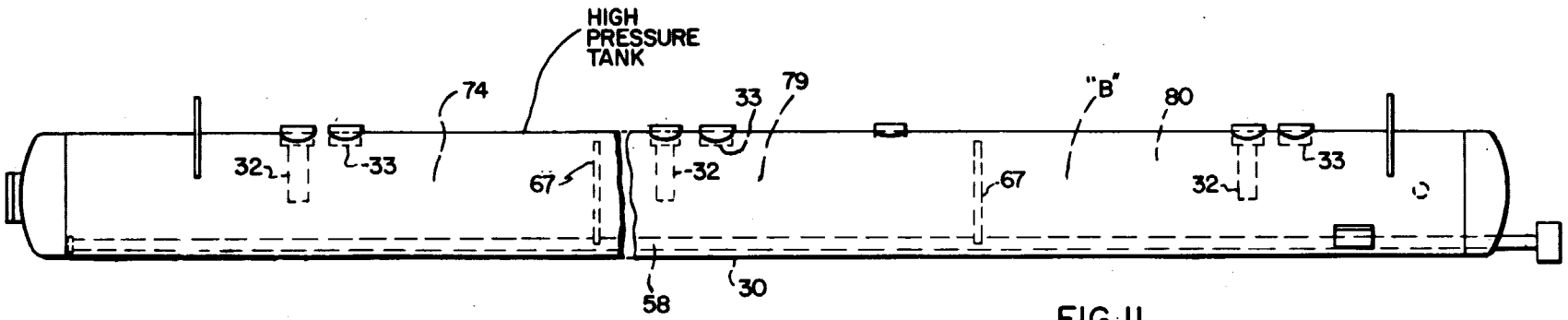
FIG. 11 is a side-elevational view of the high-pressure gas reservoir chamber of FIG. 10.
Figure 13:
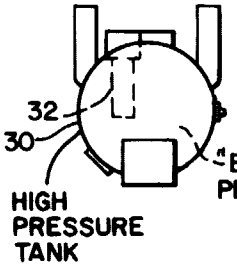
FIG. 13 is a somewhat diagrammatic end view illustrating the circulating gas-conduit tubes extending upwardly from the high-pressure gas reservoir tank of the circuit-breaker of FIGS. 3–5 and the upstanding metallic supporting structures welded thereto.
Figure 12:
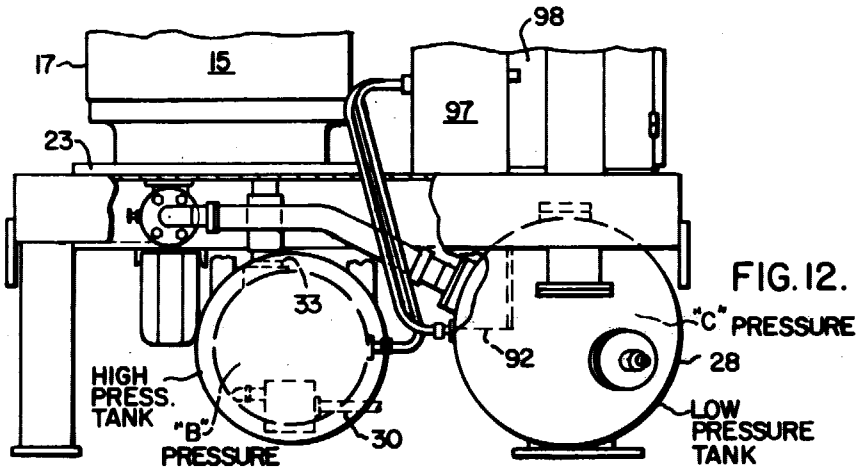
FIG. 12 is a fragmentary end-elevational view illustrating the ends of the high-pressure and low-pressure gas reservoir tanks in the installation of FIGS. 3–5.

Since the pressure-temperature characteristics of $SF_6$ gas 9 may cause it to liquefy at 200 p.s.i.g. and 48° F, it is necessary to provide heat in the high-pressure gas within region B at temperatures below 48° F. Heat is supplied by a double-element heater 58 (FIG. 11) in the high-pressure gas reservoir tank 30. The heaters 58 are automatically controlled by thermostats. Where required, pressure switches in the high-pressure system within region B, are temperature-compensated.

Figure 17:
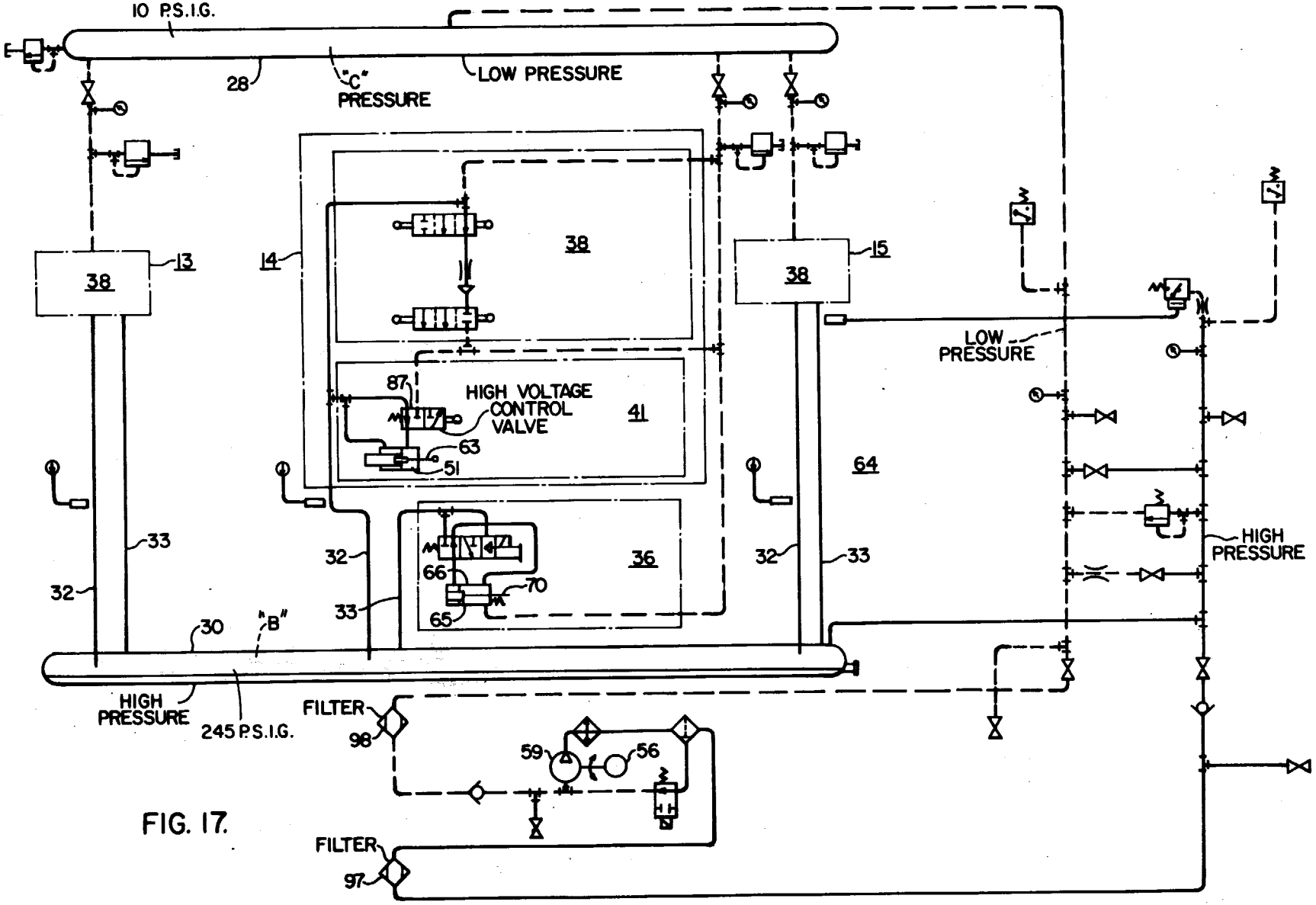
FIG. 17 is a schematic diagram of the high and low-pressure gas systems illustrating the pneumatic component parts thereof; and, FIG. 18 is a schematic diagram of the pneumatic gas control lines, and indicates the method of selectively closing the valve structures and measuring any leakage of high-pressure gas out of the relatively small-volume individual high-pressure gas-chambers of the individual circuit-breaker modules.

When the circuit-breaker 1 operates, it discharges gas 9 from the high-pressure side, region B, to the low-pressure side, region C, and raises the pressure in the low-pressure side, region C. The low-pressure governor switch actuates at 11 p.s.i.g. and completes the circuit of the line-starter coil to close the line-starter, energizing the compressor motor 56 (FIG. 17), and pumping the gas 9 from the low-pressure side C to the high-pressure side B. After normal low pressure is reached (10 p.s.i.g.) the low-pressure governor switch opens to de-energize the line-starter and stop the compressor 59 (FIG. 17).

Figure 9:
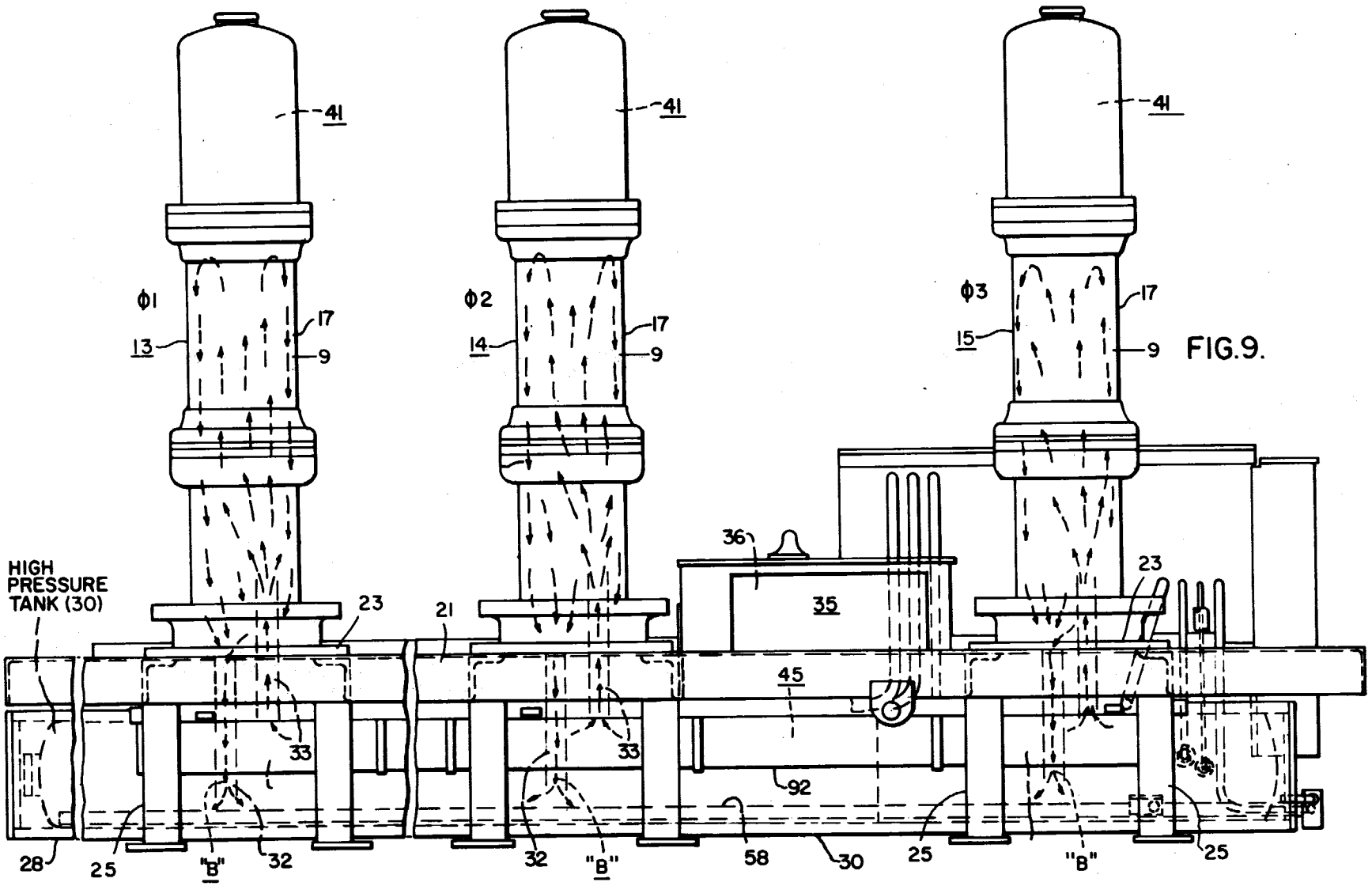
FIG. 9 is a side-elevational view of the three-phase circuit-breaker installation of FIGS. 3–5, illustrating the circulating gas-flow conditions extending upwardly from the high-pressure gas reservoir tank, and the general control-and-mechanism housing arrangement.
Figure 10:
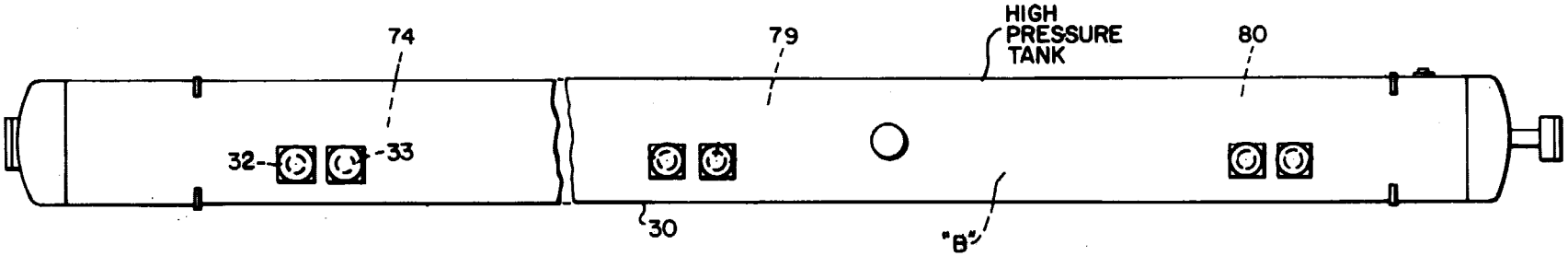
FIG. 10 is a top plan view of the high-pressure gas reservoir tank of the circuit-breaker installation of FIGS. 3–5.

As mentioned, briefly during the opening operation of each interrupter module 38, the upper movable contact 19 moves upwardly away from the lower stationary contact 20, as illustrated in FIG. 8, establishing an arc therebetween (not shown), and effecting circuit interruption. Where desired, a movable isolator contact may be moved to the open and closed-circuit positions by suitable mechanism, constituting no part of the present invention, and the details of which may be obtained from a study of U.S. Pat. No. 3,700,840 — Wilson, and U.S. Pat. No. 3,694,592 — Kuhn. o Preferably a highly-insulating gas 9, such as sulfur-hexafluoride ($SF_6$) gas, is utilized throughout the gas systems, A, B and C, through the gas-insulated piping 3, and also within the circuit-interrupter assemblies 13, 14 and 15, as illustrated in FIG. 9.

Figure 5:
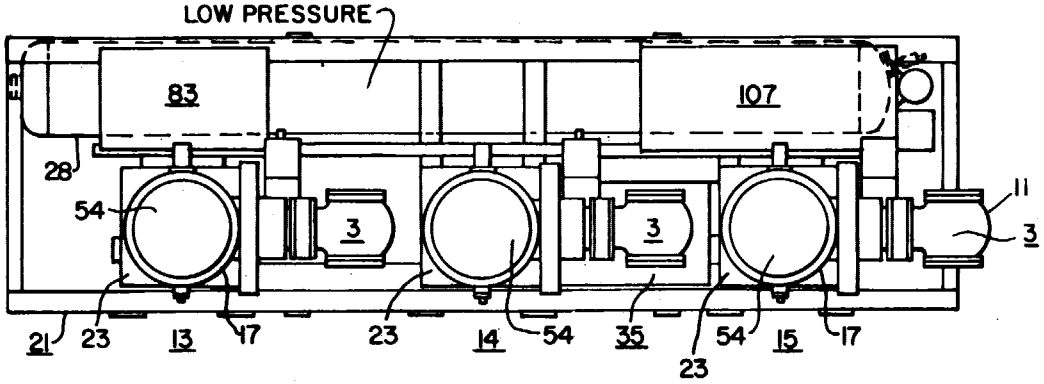
FIG. 5 is a top plan view of the three-phase gas-insulated circuit-breaker installation of FIGS. 3 and 4.

With reference more particularly directed to FIGS. 3–5, it will be observed that there are provided three upstanding circuit-breaker assemblies designated by the reference numerals 13, 14 and 15, and supported upon the lower frame-support, generally designated by the reference numeral 21. Each of the upstanding circuit-interrupter columns, or circuit-breaker assemblies 13, 14 and 15, is pneumatically actuated by the ground-potential operating mechanism 36 of the pneumatic type, and illustrated more clearly in FIG. 16 of the drawings. The location of such ground-potential operating mechanism is indicated by the reference numeral 36 in FIGS. 3 and 9.

Figure 15:
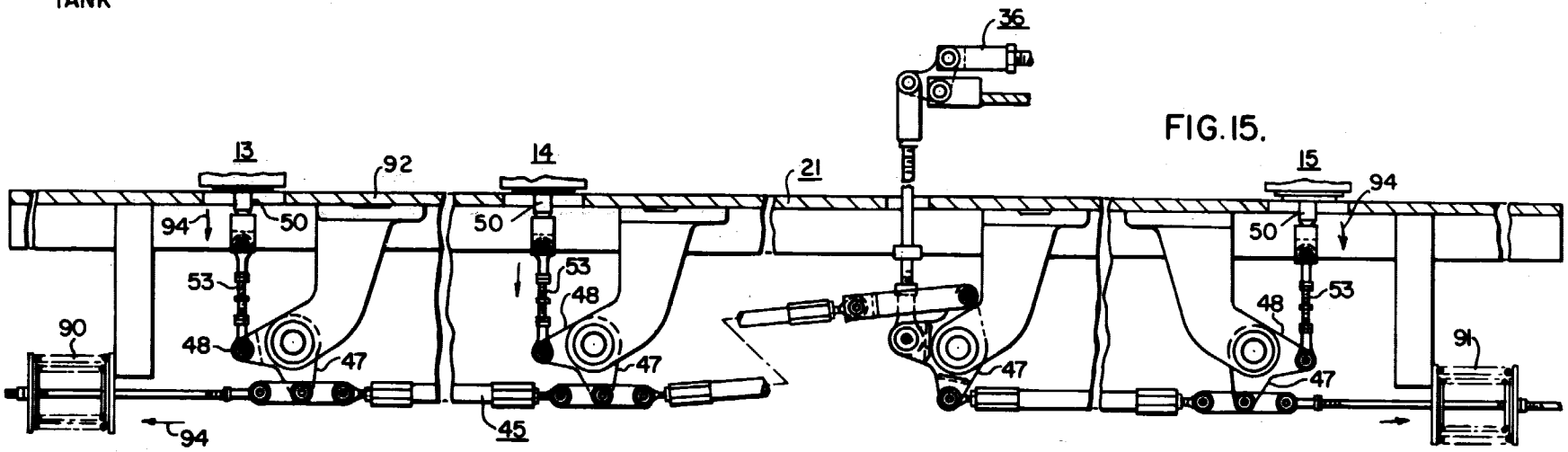
FIG. 15 is a fragmentary sectional longitudinal view of the ground-potential operating mechanism linkage utilized to initiate operation of the rod-linkage for controlling the control-valve structures in each of the three upstanding pole-units, the operating mechanism being illustrated in the breaker-open circuit position.

Generally, the ground-potential operating mechanism 36, disposed within the lower grounded mechanism housing 35, serves to actuate, a horizontally-extending adjustable linkage 45, illustrated in FIG. 15, the latter being connected with a plurality of bell-cranks 47, one arm 48 of each of which is pivoted to a vertical valve-control actuating rod 50, which extends upwardly within the circuit-breaker assemblies 13, 14 and 15 to operate the high-potential operator 41, the latter being disposed within the upper extremity of each of the circuit-breaker pole-units 38, reference being had to FIG. 6 in this regard. U.S. Pat. No. 3,639,713 issued to Fischer et al, on Feb. 1, 1972, and assigned to the assignee of the instant application, sets forth, in detail, the operation and function of the pneumatic high-potential operating mechanism 41, disposed in the upper cap portion 52 of each circuit-breaker module 38, and functioning to effect the opening and closing movements of the movable contact 19 within each of the circuit-breaker units 38. As shown more clearly in FIG. 6, the cap 52 is disposed interiorly of the outer grounded removable cover 54 constituting the upper part of the casing 17.

FIGS. 7 and 8 illustrates more clearly the open and closed-circuit positions of the separable contact structure 19, 20 and reference may be had in this regard to U.S. Pat. No. 3,639,713, —Fischer et al, which describes, in detail, the operation of the primary and secondary blast-valve structures 55, 57. Generally speaking, as shown in the closed-circuit breaker position of FIG. 7, the movable contact 19 itself serves as a movable blast-valve 55 to segregate the high-pressure region B, which may be, for example, at 245 p.s.i.g., and the low-pressure region C, interiorly of the closed contact structure, which may be at a much lower pressure level—say, for example, 10 p.s.i.g.

Opening and closing of the movable contact 19 is effected, as mentioned hereinbefore, by a pair of operating rods 60, 61, (FIGS. 7 and 8) generally simulating a ladderlike arrangement, which are interconnected at the upper end by a cross-arm, or yoke structure 63 (FIG. 8), which is, in turn, linked to the pneumatic piston 51 (FIG. 17) disposed in the upper high-potential operator, designated by the reference numeral 41 in FIG. 6 of the drawings.

The pneumatic control system 64 for the multiphase compressed-gas circuit-breaker installation 1 of the instant application is set forth diagrammatically in FIG. 17 of the drawings. With reference to FIG. 17, it will be observed that there is provided a high-pressure storage tank 30 and the low-pressure storage tank 28, the high-pressure storage tank 30 having a pair of feed pipes 32, 33 extending upwardly into each of the interrupter modules 38. Reference may be had to a companion U.S. Pat. application, filed Nov. 11, 1974, Ser. No. 522,960 by H. O. Soles, et al, and assigned to the assignee of the instant application, for a detailed description of the gas-circulating arrangement and the baffle construction 67 (FIG. 11) associated with the high-pressure storage tank 30 to insure somewhat segregated compartments 74, 79 and 80 (FIG. 11) in the high-pressure storage tank 30, itself, and encouraging the proper high-temperature gas-flow circulation of gas 9 within each of the circuit-breaker assemblies 13, 14 and 15.

Figure 16:
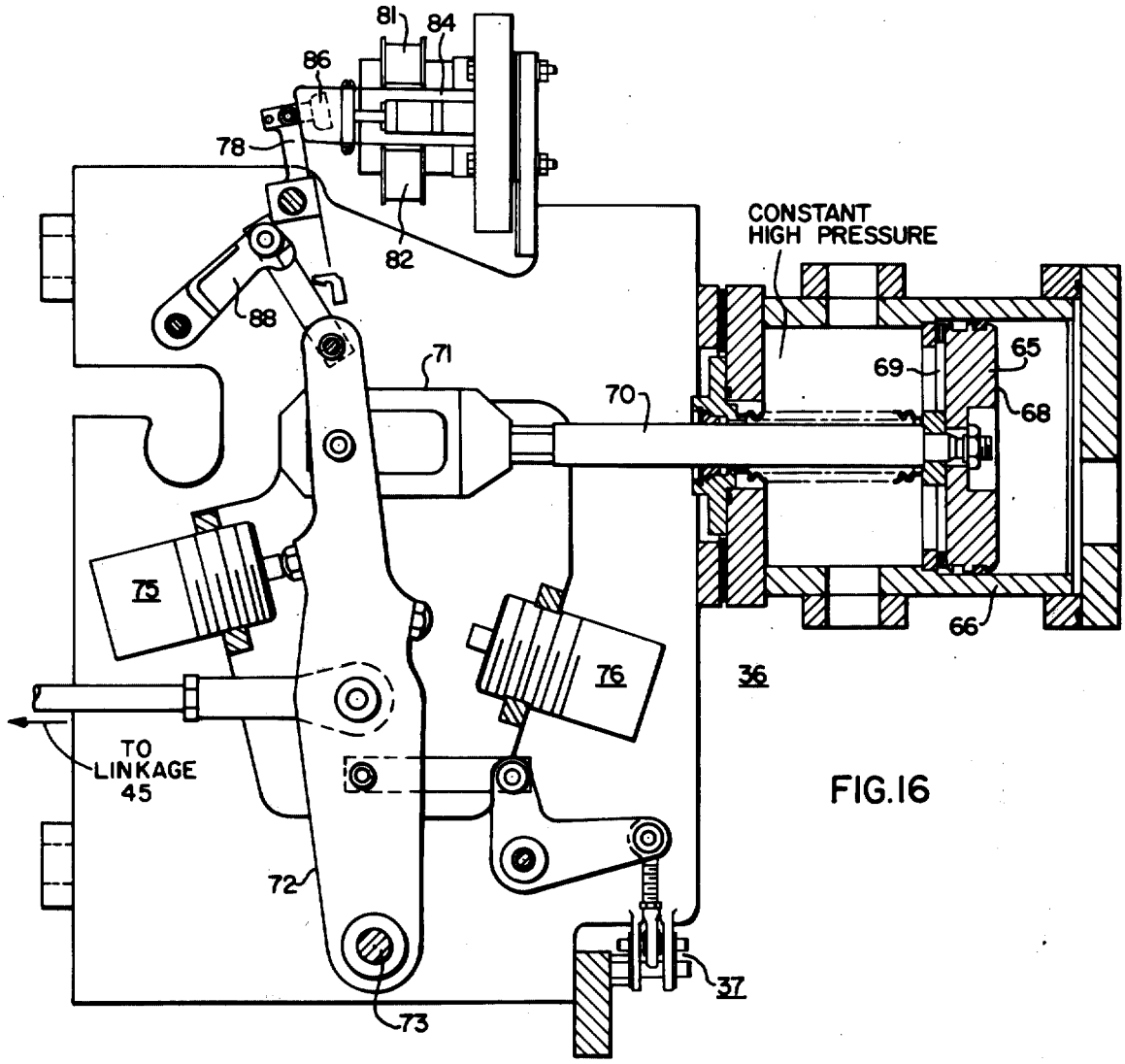
FIG. 16 is an enlarged fragmentary vertical sectional view of the ground-potential operator for the three-phase circuit-breaker installation of the present invention, indicating the pneumatic driving piston for actuating the main rotatable operating lever, the linkage structure being illustrated in the trip-released contact-separated position with the main operating lever being shown in its open position.

With particular reference being directed to the ground-potential operating mechanism 36, illustrated in FIG. 16, it will be observed that there is provided a pneumatic piston 65 disposed in an operating cylinder 66, and operating linearly by pressure differences across its two faces 68, 69, and serving to actuate a piston-rod 70, the latter being connected by a lost-motion linkage 71 with a main lever-arm assembly, designated by the reference numeral 72 in FIG. 16, and pivotally mounted upon a stationary pivot 73. Reference may be had to U.S. Pat. application filed Sept. 27, 1973, Ser. No. 401,520, now U.S. Pat. No. 3,930,134, issued Dec. 30, 1975 to Joseph Rostron et al for a detailed description of the method of operation of this ground-potential operating mechanism 36. A pair of oppositely-disposed bumper assemblies 75, 76 (FIG. 16) is provided to cushion the ends of the opening and closing movements of the lever-arm assembly 72. In addition, FIG. 16 shows the tripping lever 78 and the trip coils 81, 82 associated with the magnet structure 84, which, when released in accordance with the disclosure of the aforementioned U.S. Pat. application No. 3,930,134, effects release of the armature 86, and permits collapse of the trip-lever linkage 88, thereby permitting the tail, or accelerating springs 90, 91 (FIG. 15) associated with the ends of the horizontally-extending operating-rod linkage 45, to quickly effect opening movement of the rod-linkage 45, and consequently, the upstanding valve-rods 50. These movable upstanding valve-rods 50, of course, effect initiation of the opening movement of the high-potential pneumatic operator 41 in the manner set forth in the aforesaid U.S. Pat. No. 3,639,713.

An important feature of the present invention is the compact, serviceable and easily-adjustable aspects of the horizontally-extending operating rod-linkage 45 interconnecting the ground-potential operator 36 with the high-potential operator 41, the latter, as mentioned, being disposed at the upper extremities of the individual circuit-breaker modules 38. FIG. 6 shows this in more detail.

It will be observed that the horizontally-extending interconnecting valve-rod linkage 45 extends across the front of the circuit-breaker installation 1 within a longitudinally-extending housing, designated by the reference numeral 92 in FIGS. 4 and 9. As a result, adjustment may be readily made. FIG. 15, of course, additionally shows the two "tail", or accelerating opening springs 90, 91, which are disposed at the opposite extremities of the rod-linkage 45, and serve to move the rod-linkage 45, and hence the valve control rods 50, in an opening direction, indicated by the arrows 94 in FIG. 15.

The compact weatherproof mechanism housing 35 is located between two phase units 14 and 15. This housing 35 contains the ground-potential operating mechanism 36 and associated auxiliary switches 37, which provide closing and tripping control for the circuit-breaker 1. The control housing 83 (FIG. 5) is located adjacent to phase 1. This cabinet 83 houses all the breaker-control relays, pressure switches, terminal blocks and a hermetic sealed gas compressor 59, which is used to maintain the appropriate pressure levels within the circuit-breaker installation. There are mounted externally of the cabinet high and low-pressure filters 97, 98 (FIGS. 4 and 17) for drying the gas. The high-pressure filter 97 is thermally insulated and heated with a thermostatically-controlled heater.

The operating mechanism 36 includes pilot valves for pneumatic closing and trip coils 81, 82, which, when energized, transmit intelligence through an interphase rod and control valve rod 50 to the control valves 87 (FIG. 17) at the upper end of the individual operators 41. The operators 41 use high-pressure $SF_6$ gas 9 for their energy source. Position of the control valves 87 determines the position of the high-potential operating piston 51, and, therefore, the position of the movable contacts 19 internally of the circuit-interrupter modules 38.

Arc-extinction occurs by an initial separation of the primary blast-valves 55 constituted, in effect, by the stationary and movable main contacts 19, 20. Secondary blast-valves 57 (FIG. 7) are in an open position at the initiation of the opening operation, but subsequently close when arcing has been extinguished to avoid a dissipation of the high-pressure gas 9 unnecessarily. The interrupter 38 is designed with the contacts 19, 20 surrounded by high-pressure $SF_6$ gas 9 in high pressure region B to give a minimum arcing time.

The particular circuit-breaker 1 under discussion has, for example, a single gas system 64 for interruption and operation. Preferably, although not necessarily, three pressures are utilized—for example, 245 p.s.i.g. (region B) surrounding the main separable contacts 19, 20, 45 p.s.i.g. (region A) for interconnecting the gas-insulated piping 3 to the circuit-breaker 1 itself, and 10 p.s.i.g. (region C) contained in the low-pressure reservoir tank 28.

If a leak occurs from the high-pressure volume 93 (FIG. 6) to the low-pressure volume 96 (FIG. 6) within the interrupting module 38, it is essential to know which column 13, 14 or 15 the gas leak is in. Otherwise, the entire circuit-breaker 1 must be checked for gas leakage. Knowing which column, 13, 14 or 15 the gas leak is in, cuts down the repair cost two-thirds, or less.

Figure 18:
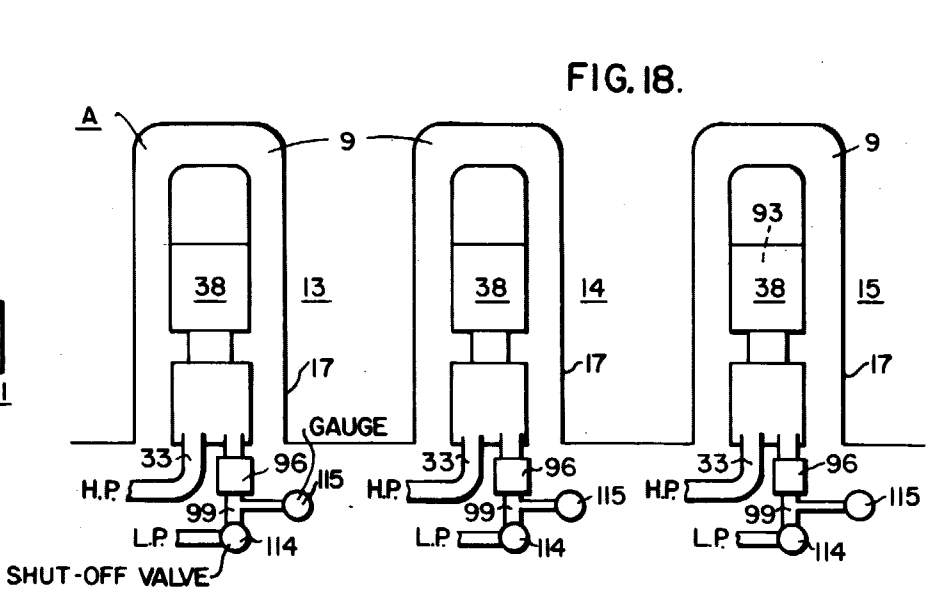
Figure 14:
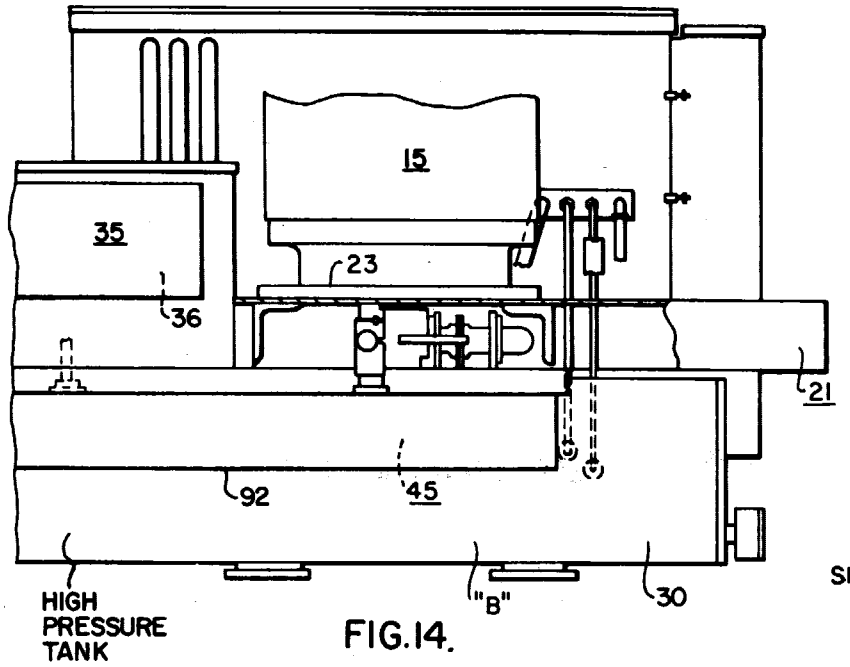
FIG. 14 is a fragmentary side-elevational view of certain mechanism equipment and illustrating the end of the high-pressure gas reservoir tank of the installation of FIGS. 3–5.

The operation is as follows referring to FIG. 18 of the drawings: close valve 114. If pressure does not increase in a short time span in gauge 115, there is no leak in column 13 (FIG. 18). The same procedure is employed for columns 14 and 15. If the pressure increases, then this is the particular column that then has the gas leak.

From the foregoing it will be apparent that by the novel location of the valves 114 and gauges 115, the operator is sure which column is the defective, or leaking column, and has a gas leak from the high-pressure region 93 to the low-pressure region 96. Thus, this section process cuts down considerably the necessary maintenance time.

A very important feature of the present invention, as mentioned, is the ease of detecting high-pressure gas leakage from the high-pressure gas system B (volume 93) to the low-pressure gas system C (volume 96). This is achieved by closing the ball valves 114 of one column, and watching a rise of gas pressure within the pressure gauge 115 associated with the particular interrupter column 13, 14 or 15 being tested. Due to the low volume 96 of the low-pressure gas system C in each of the circuit-breaker modules 38, gas leakage will cause a somewhat rapid rising of gas pressure in the particular low-pressure volume 96, which may be readily detected by the maintenance operator by viewing the individual pressure gauge 115, located at the lower end of the particular circuit-breaker column 13, 14 or 15 being leak checked.

It will be observed that the location and disposition of the control-housing assembly 83 (FIG. 5) and the horizontally-extending adjustable valve-rod linkage 45 is available for facilitated adjustment. Additionally, it will be noted that the operating mechanism 36 is located directly over the horizontal rod-linkage assembly 45 with direct-line motion, as illustrated more clearly in FIG. 15 of the drawings. Also, it will be observed that there is provided direct gas-feeds to the high-pressure and low-pressure tanks.

From the foregoing, it will be apparent that there has been provided an easily-serviceable circuit-breaker installation 1 with an easy check being provided for leakage that may occur between the high and low-pressure volumes 93, 96 within each circuit-breaker column 13, 14 or 15. Additionally, it will be noted that there is provided easy accessibility to the horizontal and vertical valve-rod adjustments 53 (FIG. 15), and easy accessibility to the weather covers 92 provided over the horizontal valve-rod linkage 45. Thus, maintenance is quickly and easily obtained with a minimum of down time.

Although there has been illustrated and described a particular compressed-gas circuit-breaker installation, it is to be clearly understood that the same was merely for the purpose of illustration, and that changes and modifications may readily be made therein by those skilled in the art, without departing from the spirit and scope of the invention.

What is claimed is:

1. In combination, means defining a plurality of gas-blast circuit-breaker assemblages (13, 14, or 15) collectively constituting a multiphase compressed-gas circuit-breaker installation, each assemblage (13, 14 or 15) including a pair of separable contacts constituting primary blast-valve means, one of said separable contacts being hollow and constituting a hollow venting contact, each gas-blast circuit-breaker assemblage (13, 14 or 15) including means defining a relatively large-volume high-pressure region B located externally of said respective separable contacts (19, 20) of the particular assemblage, means defining a relatively small-volume low-pressure region C downstream of said one hollow venting contact (19 or 20), the low-pressure region C of the assemblages (13, 14 or 15) all communicating through individual gas-valves (114) to a common low-pressure gas reservoir tank (28), an individual gauge (115) interposed between each individual gas-valve (114) and the individual low-pressure volume C for the respective gas-blast circuit-breaker assemblage (13, 14 or 15), whereby closing the individual gas-valve (114) of a respective assemblage (13, 14 or 15) will enable maintenance personnel to observe a rise of pressure in a particular individual volume C to thereby selectively determine gas leakage of a particular assemblage (13, 14 or 15) to the exclusion of the other circuit-breaker assemblages (13, 14 or 15).

2. The combination in a multi-phase, high-voltage compressed-gas circuit-interrupter assemblage of a plurality of individual, gas-blast, circuit-breaker pole-units (13, 14, 15), means defining a common high-pressure gas-reservoir chamber, means defining a common low-pressure gas-reservoir chamber, each of the pole-units including a pair of separable contacts separable to establish an arc, blast-valve means for introducing a flow of high-pressure gas from a high-pressure volume B adjacent the contacts into said established arc to extinguish the same and exhausting into a downstream low-pressure region C, the high-pressure volume B within each of the pole-units being connected by a high-pressure conduit to said common high-pressure gas-reservoir chamber maintained at a high-pressure level, the low-pressure region C of each of said pole-units being pneumatically connected through an individual shut-off valve (114) to said common low-pressure gas-reservoir chamber, an individual pressure gauge (115) connected to the interrupter side of each individual shut-off valve (114) to enable a visual determination of the pressure level present within the low-pressure volume C, the volume of the high-pressure region B within each of the pole-units being considerably greater than the volume C of the low-pressure region individual to each of said pole-units, whereby maintenance personnel may individually and also selectively close off the shut-off valve (114) individual to a particular pole-unit being tested to thereby enable a visual detection of a rise of pressure within the relatively low-volume, low-pressure region C individual to the particular pole-unit being tested, whereby maintenance personnel may observe a rise of pressure in a particular individual low-pressure volume C to thereby selectively determine possible gas leakage in a particular pole-unit (13, 14 or 15) to the exclusion of the other adjacently-disposed pole-units (13, 14 or 15).

3. The combination according to claim 2, wherein the pole-units are of an upstanding construction having high-voltage line-terminal means $L_1$ disposed adjacent the upper end of each of the pole-units, and the shut-off valve (114) and pressure gauges (115) are disposed at a lower spacial physical level and at ground potential.

4. The combination according to claim 2, wherein the blast-valve means is constituted by the abutment engagement of the separable contacts, whereby a forcing of the separable contacts to their open-circuit position will automatically effect the opening of the particular blast-valve means associated with the particular pole-unit, and at least one of said separable contacts having a hollow, vented construction, whereby high-pressure gas may be exhausted through said one hollow-vented contact to the low-pressure gaseous region C.

5. A multi-phase, compressed-gas, circuit-breaker installation comprising, in combination, a generally-rectangularly-shaped lower main support frame (21), means for supporting said support-frame (21) upwardly away from lower foundation level, common high-pressure and low-pressure gas-reservoir tanks (28, 30) disposed in the area between lower foundation level and said horizontally-extending generally rectangular support-frame (21), a plurality of upstanding circuit-breaker assemblies (13, 14, 15) extending upwardly and spaced laterally apart and supported by said lower-disposed rectangularly-shaped support-frame (21), said circuit-breaker assemblies (13, 14, 15) being laterally spaced apart from each other, a high-pressure gas conduit leading from the high-pressure gas-reservoir chamber (30) to the separable contact structure of each pole-unit, a relatively-low-pressure gas conduit leading through an individual shut-off valve (114) to said common low-pressure gas-reservoir chamber (28), each low-pressure gas conduit having an individual pressure gauge (115) disposed on the interrupter side of said shut-off valve (114), the volume B of high pressure gas associated with the interrupter of each individual pole-unit being of relatively large volume with respect to the relatively small volume C of the low-pressure gas space individual to each pole-unit on the upstream side of the shut-off valve (114), whereby closing of the individual shut-off valve (114) of a respective pole-unit, (13, 14, or 15) will enable maintenance personnel to observe a rise of pressure in the particular individual low-pressure, low-volume region C to thereby selectively determine possible gas leakage of a particular pole-unit (13, 14, or 15) to the exclusion of the other circuit-breaker pole-units (13, 14 or 15).

* * * * *